US008058317B2

(12) United States Patent
Nguyen

(10) Patent No.: US 8,058,317 B2
(45) Date of Patent: Nov. 15, 2011

(54) NITRATED EXTREME PRESSURE ADDITIVES AND BLENDS

(75) Inventor: Duong N Nguyen, Dover, OH (US)

(73) Assignee: Dover Chemical Corporation, Dover, OH (US)

( * ) Notice: Subject to any disclaimer, the term of this patent is extended or adjusted under 35 U.S.C. 154(b) by 152 days.

(21) Appl. No.: 11/778,373

(22) Filed: Jul. 16, 2007

(65) Prior Publication Data

US 2007/0270509 A1 Nov. 22, 2007

Related U.S. Application Data

(63) Continuation-in-part of application No. 11/626,502, filed on Jan. 24, 2007, now Pat. No. 7,960,323.

(60) Provisional application No. 60/939,181, filed on May 21, 2007, provisional application No. 60/766,581, filed on Jan. 30, 2006.

(51) Int. Cl.
*B01F 3/08* (2006.01)
*B01F 17/00* (2006.01)
*C09K 3/00* (2006.01)

(52) U.S. Cl. ..... 516/67; 508/549

(58) Field of Classification Search ..... 564/494; 508/477, 422, 506, 549; 568/785; 516/67
See application file for complete search history.

(56) References Cited

U.S. PATENT DOCUMENTS

| | | | | |
|---|---|---|---|---|
| 2,196,101 | A * | 4/1940 | Carmichael et al. | 508/477 |
| 4,076,738 | A | 2/1978 | Pecoraro | |
| 4,347,148 | A | 8/1982 | Davis | |
| 4,410,746 | A | 10/1983 | Eckler | |
| 4,711,736 | A | 12/1987 | Horodysky et al. | |
| 4,776,969 | A * | 10/1988 | Ryer et al. | 508/422 |
| 5,103,061 | A | 4/1992 | Blackborow et al. | |
| 5,144,082 | A * | 9/1992 | Forbus et al. | 568/785 |
| 5,213,697 | A | 5/1993 | Vinci et al. | |
| 5,454,842 | A | 10/1995 | Poirier et al. | |
| 5,663,130 | A * | 9/1997 | Emert et al. | 508/506 |
| 6,001,782 | A | 12/1999 | Huang | |
| 6,069,281 | A * | 5/2000 | Kropp et al. | 564/494 |
| 6,362,381 | B1 | 3/2002 | Eiermann et al. | |
| 2001/0037598 | A1 | 11/2001 | Suppes et al. | |
| 2007/0099803 | A1 | 5/2007 | Nguyen | |

FOREIGN PATENT DOCUMENTS

| | | |
|---|---|---|
| WO | WO2007103595 | 9/2007 |

OTHER PUBLICATIONS

PCT—International Preliminary Report on Patentability and Written Opinion from KIPO dated Dec. 3, 2009.

* cited by examiner

*Primary Examiner* — Michael Marcheschi
*Assistant Examiner* — Chantel Graham
(74) *Attorney, Agent, or Firm* — Hahn Loeser & Parks LLP

(57) ABSTRACT

This Invention relates to products and processes for making extreme-pressure additives (water-dispersible and oil-based). The process includes nitrating fatty raw material sources such as animal fats, vegetable oils, the fatty acids and synthetic esters derived therefrom, terminal or internal olefins, polyalkenes or their linear copolymers, and alkylated phenols, using 70% nitric acid or nitrogen dioxide gas. The additives are used as soluble oils or as lubricating blends by the inclusion of emulsifiers. The nitrated unsaturated fatty acids such as tallow fatty acid, oleic acid, tall oil fatty acid, tall-oil derived dimer acids, castor oil fatty acid, alkyl succinic acids, are modified by post-reaction to form alkanolamine (monoethanolamine, triethanolamine) salts or alkanolamides in order to obtain the derived water-dispersible nitro-EP additives. The same nitration method is used to make ethoxylated fatty esters by reaction with water-soluble polyglycols in order to obtain water-dispersible nitro-EP additives.

25 Claims, No Drawings

NITRATED EXTREME PRESSURE ADDITIVES AND BLENDS

CROSS-REFERENCE TO RELATED APPLICATIONS

This application claims Priority from Provisional Application 60/939,181, filed 21 May 2007 and is a continuation-in-part application of U.S. patent application Ser. No. 11/626,502, filed on 24 Jan. 2007, now U.S. Pat. No. 7,960,323, which issued on 14 Jun. 2011 which claims priority to U.S. Provisional Patent Application Ser. No. 60/766,581 filed 30 Jan. 2006.

TECHNICAL FIELD

This invention relates generally to the synthesis and use of oil-based as well as water-dispersible nitrated extreme pressure (hereinafter "EP") additives and blends, optionally in synergistic combination with other chlorine-free EP additives.

BACKGROUND OF THE INVENTION

Lubricating oils form interfacial films between moving metallic parts. These oils typically contain one or more of the following additives: boundary additives, corrosion inhibitors, anti-oxidants, dispersants, anti-wear additives, and extreme-pressure ("EP") additives. Boundary, antiwear, and extreme-pressure additives are typically grouped as performance additives while the others as functional additives. This invention pertains to the synthesis and use of nitrated extreme-pressure additives.

Among the performance additives, the primary function of a boundary additive is to reduce friction generated by metal-to-metal rubbing. These additives can be fatty oils, fatty esters, soaps consisting of oxygen-containing functional groups and long-chained hydrocarbons. They are only effective up to temperatures of approximately 150° C. and are therefore effective and useful only for light-duty operations involving soft metals such as copper or aluminum, or light-duty applications involving cast-iron or steel.

For a medium-duty or moderate loads processing steel, low levels of sulfurized additives and/or anti-wear additives such as ZDDP (zinc dithiophosphates), or phosphate esters and phosphites are typically employed. These phosphorous-based compounds are effective up to around 300° C. but lose their effectiveness at higher temperatures.

For heavy-duty applications involving hardened steel, particularly at higher speed and loadings, the extreme-pressure additives such as sulfurized and chlorinated additives have traditionally been employed. These species react with metal surfaces at much higher temperatures ranging from 350° C. for chlorinated additives and from 500° C. for sulfurized additives. Through chemi-adsorption with the metal, these additives form a sacrificial coating to prevent not only wearing, but also welding or adhesion between two dissimilar metal surfaces, such as a die and a work piece.

Presently, commercial extreme-pressure additives contain one or more sulfur, chlorine, or phosphorus-containing compounds. Sulfur-containing additives are sulfurized fat or fatty esters or synthetic polysulfides; chlorine-containing additives are chlorinated paraffins, olefins, or chlorinated fatty compounds; while phosphorus-containing additives consist of phosphate esters and phosphites. Each of the above-mentioned commercial extreme-pressure additives has its own set of limitations.

Sulfurized additives are effective for working with steel parts but not those involving stainless steel or special alloys such as titanium, chromium, or nickel-based, especially those in the most severe working environments. Phosphate esters or phosphites are excellent anti-wear or load-carrying additives but only in light-duty applications. For most cases, they are not effective extreme-pressure additives and definitely unsuitable for applications involving stainless steel. One of the reasons is that these phosphorus and sulfur-containing additives are not very reactive to hardened steel or low-iron metallic composites such as stainless or special alloys mentioned above. Chlorinated compounds, on the other hand, are very effective in wide range of metal processing applications involving both steel, stainless steel, and special alloys. The rule of thumb in the industry is that chlorinated additives are required for working with these exotic alloys of low or no iron content. However, recent environmental concern regarding the disposal of chlorinated compounds has prompted the lubricant industry to search for alternatives to replace the chlorinated additive workhorse.

This invention describes a novel class of extreme-pressure additives, labeled generically as "nitrated" or nitro compounds. The nitro compounds cited in this invention can be made by using 70% nitric acid or nitrogen dioxide gas to nitrate many classes of compounds, such as: (1) fatty acids with unsaturation; (2) fatty oils which contain unsaturation sites on their hydrocarbon chains such as vegetable oils, tall oil and animal fats; (3) esters (synthetic or natural) derived from the reaction of alcohols with fatty acids, such as triglycerides; (4) $C_2$-$C_{28}$ simple terminal or internal olefins, more preferably $C_8$-$C_{18}$ olefins; (5) $C_2$-$C_{20}$ polyolefins or $C_4$-$C_{20}$ polydiolefins, more preferably $C_2$-$C_6$ polyolefins containing terminal or internal unsaturation, preferably polyisobutylene (hereinafter "PIB"); (6) $C_8$-$C_{20}$ copolymers derived from polyolefins and vinyl aromatics e.g., poly(styrene butadiene); and (7) $C_4$-$C_{30}$ alkylated phenols, e.g., nonyl phenol and wherein the alkyl group is a straight or branched chain.

At least one novel feature of this additive is that it contains nitro-compounds instead of conventional elements such as sulfur, chlorine, or phosphorus, and has demonstrated its effectiveness as an extreme-pressure additive capable of replacing (either completely or at least partially) both sulfurized chlorinated, and phosphated additives for both steel and stainless steel applications, for aluminum applications, as well as for processing metallic alloys which are currently considered as most challenging such as titanium, nickel, and chromium-based metals or alloys.

U.S. Pat. No. 4,076,738 describes how to make polyisobutylene carboxylic acid by reacting ozonized polyisobutylene with nitric acid for use in the area of fuel and gasoline additives.

U.S. Pat. No. 4,347,148 describes a process of preparing nitro-phenols by reacting polyisobutylene-substituted phenols with nitric acid in presence of sulfuric acid or a Lewis acid. The nitro-phenols were indicated to be useful as fuel dispersants in combustion engines.

U.S. Pat. No. 4,410,746 describes a process preparing nitro-olefins comprising reacting a nitro diol with an aldehyde acceptor in the presence of a catalyst. Such nitro-olefins can be used as solvents or pesticides.

U.S. Pat. No. 5,103,061 describes a nitration process of polyisobutylene ("PIB") using nitrogen oxides gas and subsequent derivatives to generate fuel additives.

U.S. Pat. No. 5,454,842 describes an esterification process of fatty alcohols derived from the reduction of tall oil fatty acid and vegetable oils with nitric acid. The obtained product is a nitrate and the end use is cetane improver for diesel fuel.

U.S. Pat. No. 6,069,281 describes the nitration process of polybutenes or polyisobutylene with nitrogen oxides and further processing with hydrogenation to produce polyamine derivatives for fuel additives.

U.S. Pat. No. 6,362,381 B1 describes the nitration of aromatic hydrocarbons with oxides of nitrogen, an oxygen-containing gas and an oxidic catalyst. The described end use is in the area of fuel additives.

U.S. Pat. No. 6,888,030 B2 describes a process of producing polyamines by hydrogenation of nitrated polyisobutylenes in the presence of a branched alcohol, using 70% nitric acid. The end use for the invented product is fuel additives.

Unites States Patent No. 2001/0037598A1 describes a process of nitration to produce nitrated methyl esters derived from vegetable oils. The final product is a nitrated compound and not a nitro compound as illustrated in the current invention. Additionally, the published application teaches an end use for the nitrated methyl esters as cetane improvers for diesel fuel.

This invention describes a novel class of oil-based as well as water-dispersible extreme-pressure additives, labeled generically as "nitrated" compounds. In one embodiment, these additives can be used synergistically with at least one non-chlorine containing additive. At least one novel feature of the nitrated additive is that it contains no or reduced amounts of conventional elements such as sulfur, chlorine, or phosphorus, and has demonstrated its effectiveness as an extreme-pressure additive capable of replacing or partially replacing sulfurized, phosphated, and primarily chlorinated EP additives for both steel and stainless steel, as well as the above-mentioned non-ferrous applications.

SUMMARY OF THE INVENTION

An object of this invention is to illustrate a process to produce the novel oil-based generically-called "nitrated" or more scientifically accurately as "nitro" additives by nitrating fatty raw material sources such as animal fats, vegetable oils, the fatty acids and synthetic esters derived therefrom, terminal or internal olefins, polyalkenes or their linear copolymers, and alkylated phenols, using 70% nitric acid or nitrogen dioxide gas which is the anhydrous form of nitric acid as the nitrating agent.

Another object of this invention is to illustrate the novel uses of these above-mentioned oil-based nitro additives as the extreme-pressure or EP additives in various industrial lubricants such as engine oils, hydraulic fluids, gear oils, chain oils, drilling muds, and the like, and also as metal working fluids for various kinds of metals, including both ferrous and non-ferrous, and their alloys, particularly aluminum, stainless steel, titanium, nickel, and chromium alloys.

A further object of this invention is to illustrate the novel use of these above-mentioned oil-based nitro additives as extreme-pressure or EP additives in various industrial lubricants and metal working fluids, in the form of soluble oils or as lubricating blends which contain the novel nitro EP additives and emulsifiers together blended into an oil-based carrier of petroleum oils or synthetic esters.

A still further object of this invention is to illustrate the novel uses of these above-mentioned oil-based nitro additives as extreme-pressure or EP additives in synergy with conventional EP or lubricating additives such as sulfurized and phosphated additives, both in straight-oil and soluble oil formulas.

An object of this invention is to illustrate a process to produce the novel nitrated or nitro additives by nitrating unsaturated fatty acids such as tallow fatty acid, oleic acid, tall oil fatty acid, tall-oil derived dimer acids, castor oil fatty acid, alkyl succinic acids, and subsequently modifying the resulting products by post-reaction to form alkanolamine (monoethanolamine, triethanolamine) salts or alkanolamides in order to obtain the derived water-dispersible nitro-EP additives.

Another further object of this invention is to illustrate a process to produce nitrated fatty additives from fatty acids such as oleic acid or tall oil fatty acids, using the same nitration method and subsequently modifying the resultant products by post-reaction to form ethoxylated fatty esters by reaction with water-soluble polyglycols in order to obtain water-dispersible nitro-EP additives.

Yet another object of this invention is to illustrate a process to produce a water-dispersible nitro-EP additive through the nitration of ethoxylated esters of tall oil fatty acids or oleic acid which are water-dispersible as well as unsaturated fatty esters.

Yet still another further object of this invention is to illustrate a process of synergistically using water dispersible nitrated fatty additives in combination with chlorine-free additives.

Yet still a further object of this invention is to illustrate the novel uses of nitro-compounds as a new class of extreme-pressure additives which can partially or completely replace both sulfurized and/or phosphorus-containing and/or chlorinated additives, and which are effective in processing and lubricating both regular steel and low-steel or non-ferrous alloys such as stainless steel, titanium, titanium-based, nickel-based, chromium-based, and aluminum-based.

Yet still another object of this invention is to illustrate the novel uses of nitro-compounds as a new class of antiwear/extreme-pressure (EP) additives which can partially or totally replace both sulfurized and/or phosphorus-containing and/or chlorinated additives, in a wide variety of industrial lubricants and metal working fluids, both oil-based and water-based, such as engine oils, hydraulic fluids, gear oils, chain oils, two-cyle engine oils, cutting fluids, drawing compounds, and the like.

These and other objects of the present invention will become more readily apparent from a reading of the following detailed description taken in conjunction with the appended claims.

DETAILED DESCRIPTION OF THE INVENTION

The nitration process of the instant invention is carried out with many classes of compounds, an exemplary listing including: $C_2$-$C_{30}$ unsaturated fatty acids; $C_2$-$C_{30}$ unsaturated fatty oils or glycerides; esters derived from the reaction of $C_1$-$C_{20}$ alcohols with $C_2$-$C_{30}$ unsaturated fatty acids; $C_2$-$C_{28}$ terminal or internal olefins; $C_2$-$C_{20}$ polyolefins; $C_4$-$C_{20}$ polydiolefins; $C_8$-$C_{20}$ copolymers derived from polyolefins and vinyl aromatics; and $C_4$-$C_{30}$ alkylated phenols.

In a more preferred embodiment, the classes would include: $C_8$-$C_{30}$ unsaturated fatty acids; $C_8$-$C_{30}$ unsaturated fatty oils or natural triglycerides; esters derived from the reaction of $C_4$-$C_{20}$ alcohols with unsaturated $C_8$-$C_{30}$ fatty acids; $C_4$-$C_{18}$ terminal or internal olefins; $C_4$-$C_{18}$ polyolefins; $C_4$-$C_{18}$ polydiolefins; $C_8$-$C_{20}$ copolymers derived from polyolefins and vinyl aromatics; and $C_8$-$C_{20}$ alkylated phenols.

The nitrating agent can be nitric acid or nitrogen dioxide gas. When nitric acid is used as the nitrating agent, various concentrations ranging from 30% to 70% are useful in this invention.

Fatty oils suitable for the nitration have a certain degree of unsaturation or some double bonds in their hydrocarbon chains and include animal fats, vegetable oils such as soybean oil, corn oil, canola oil, castor oil, tall oil, and all similar unsaturated triglycerides.

Synthetic esters are normally derived from reacting various alcohols such methanol, butanol, 2-ethylhexanol, trimethylolpropane, pentaerythritol, sorbitol, and the like with fatty acids such as oleic acid, tall oil fatty acid, linoleic acid, linolenic acid, palmitoleic, arachidonic acid, castor oil fatty acid, tall-oil-derived dimmer acids, alkylated succinic anhydride and acids, and mixtures thereof. Illustrative examples of fatty acid esters include, but are not limited to methyl oleate, methyl soyate, methyl tallowate, methyl tallate, trimethylolpropane unsaturated esters, pentaerythritol tetraesters, diethylene glycol esters, propyleneglycol esters and 2-ethylhexyl esters.

Simple alkenes or olefins include both terminal and internal ones with carbon chain length ranging from $C_4$ to $C_{28}$.

Polyalkenes useful in this invention are preferably polybutenes or polyisobutylenes with molecular weights ranging from 300 to 4500, with 300 to 1000 preferred. Also suitable for nitration are the polymers of other alkenes or $C_2$-$C_6$ olefins such as polyethylenes, polypropylenes, polypentenes, polyhexenes, poly(methyl-2-butene), poly(ethyl-1-butene) and mixtures and blends thereof as well as polydienes, e.g., polybutadiene and polyisoprene and blends thereof.

Copolymers useful in this invention can have terminal or internal double bonds of $C_8$ to $C_{20}$ chain lengths being preferred. The polymers can be either straight or branched chain, e.g., poly(styrene butadiene), and the like, as well as mixtures and blends thereof.

The nitrating agents can be commercial nitric acid with 70% strength which can be used at 70% or be diluted further with water to 30%. The anhydrous form of nitric acid, known as nitrogen dioxide gas ($N_2O_4$) can also be used in place of nitric acid.

No catalyst was used in any nitration processes for making the novel extreme-pressure additives useful in this invention.

To distinguish the nitro-compounds, it is noted that there are similar but different nitrogen-containing chemicals, namely nitrite and nitrates. Nitrous acid ($HNO_2$) can be esterified with alkyl alcohols to yield nitrites which contain C—O bonds and the final functional group of nitrites can be schematically described as —C—O—N═O. Nitric acid ($HNO_3$) can be esterified with the same alcohols to yield nitrates which also contain C—O bonds and their functional groups can be described as —C—O—$NO_2$. On the other hand, nitric acid can undergo the electrophilic substitution or via free radical reaction to form nitro compounds which contain C—N bonds and of which the functional groups can be described as —C—$NO_2$.

Nitric acid or nitrogen oxides can induce both electrophilic substitution and free radical attacks on hydrocarbon chains, therefore, without being held to any one particular theory of operation, or mechanism, the generic nitration reaction to render the nitro compounds used in this invention can be generalized in broad terms as follows:

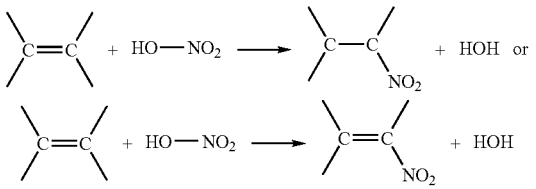

What is important is that the starting reactant (Formula II) contain at least one unsaturated site, and that post nitration reaction, the additive contains the —C—$NO_2$ or nitro group. The completion of the nitration reaction can be observed by monitoring the nitro functional group using Fourier Transform Infra-Red ("FTIR") registered at 1551 $cm^{-1}$ in contrast to 1631 $cm^{-1}$ for nitrate or —C—O—$NO_2$ group, or by monitoring the decreasing acidity of the reacting medium, or by measuring the amount of water collected which will come from two sources, the 30% water existing in the starting 70% nitric acid from the beginning and the water generated as the by-product of the nitration process. This collected water is measured and tabulated as the percent of nitric acid charged. Theoretically, the total water collected is calculated to be equal to 50% of the initial nitric acid charge. However, the yield of the nitration reaction will be slightly less than the theoretical yield due to the loss of the starting raw materials. Some nitric acid will also be lost as the gaseous oxides of nitrogen, and some nitrated organic compounds will be lost due to depolymerization or breaking down of hydrocarbon chains due to free radical degradation.

Two nitration methods are used and being described here, one is carried out at 70° C. while the other at 110° C. Also, various molar ratios between nitric acid and nitrated organics, i.e., various degrees of nitration are employed to demonstrate the great flexibility of the nitration method and broaden its scope. The charge of 70% nitric acid is not calculated based on the molecular weight of the nitrated organics but rather based on its unsaturation content or the amount of double bonds existing on the molecular chains. In some instances, the starting compounds become fully nitrated, but in most cases, the degree of nitration is preferred to be at approximately between 35-50% of the degree of unsaturation due to the exothermic nature of nitration and also due to the accelerated degradation caused by such a strong oxidizing agent as concentrated nitric acid.

Typically, at 70° C., a compound which is to be nitrated is selected from fatty oils, PIB, olefins, or alkylated phenols and is charged along with 70% nitric acid. The reacting medium is then heated to 70° C., held at that temperature for 6-8 hours. Subsequently the temperature is slowly increased to 120° C. The batch is held there for about one hour before being cooled to 80° C. Air or nitrogen is then introduced to blow out and remove essentially all entrapped water, which is collected in a Dean-Stark trap, to render a final product. Alternatively, vacuum can be applied for a similar purpose.

If the nitration is carried out at 110° C. or higher, the initial starting organic is heated to 110° C., followed by the addition of a pre-measured amount of 70% nitric acid (which is added slowly) with some cooling to maintain the reacting medium at 100-120° C. After all the nitric acid is charged, the batch is then slowly heated to 120° C., and held at that temperature for about one hour before gas blowing is introduced to remove the water by-product.

The invention is now described in more detail with reference to the following non-limiting examples.

Oil-Based Extreme-Pressure Additives

Example #1

Nitrated Soybean Oil

To a three-necked round bottom flask, equipped with a thermometer, stirring bar, Dean-Stark trap, gas sparger, and a condenser, 89.0 g (0.100 mole) of refined soybean oil and 16.1 g (0.179 mole) of 70% nitric acid were charged. The batch was heated to and maintained at 25-140° C., preferably at 60-120° C., more preferably at 70° C. for eight hours. Subsequently the temperature of the reaction was slowly increased to 100° C. The batch was maintained at 100° C. for two hours before cooling to 80° C. The batch was air-blown to remove essentially all entrapped water. A total of 8.0 g water was collected. The total weight loss was 8.7 g or 54% based on the weight of the nitric acid charge. The final yield was 96.5 g of dark brown fluid which FTIR at 1551-1554 $cm^{-1}$ indicated contained the nitro group ($C—NO_2$). The total nitric acid charge amounted to 18% by the weight of the starting organic.

Example #2

Nitrated Soybean Oil

To a three-necked round bottom flask, equipped with a thermometer, stirring bar, Dean-Stark trap, gas sparger, and a condenser, 50.0 g (0.056 mole) of refined soybean oil and 13.2 g (0.147 mole) of 70% nitric acid were charged. The batch was heated to and maintained at 70° C. for eight hours. Subsequently the temperature of the reaction was slowly increased to 100° C. The batch was maintained at 100° C. for two hours before cooling to 80° C. Finally, the batch was air-blown or vacuum applied to remove essentially all entrapped water. A total of 6.6 g water was collected. The total weight loss was 11.4 g or 57% based on the weight of the nitric acid charge. The final yield was 55.6 g of dark brown fluid which FTIR at 1551-1554 $cm^{-1}$ indicated contained the nitro group ($C—NO_2$). The total nitric acid charge amounted to 26% by the weight of the starting organic.

Example #3

Nitrated Soybean Oil

To a three-necked round bottom flask, equipped with a thermometer, stirring bar, Dean-Stark trap, gas sparger, and a condenser, 50.0 g (0.056 mole) of refined soybean oil and 20.0 g (0.222 mole) of 70% nitric acid were charged. The batch was heated to and maintained at 70° C. for eight hours. Subsequently, the temperature of the reaction was slowly increased to 100° C. The batch was maintained at 100° C. for two hours before cooling to 80° C. The batch was air-blown or vacuum applied to remove essentially all entrapped water. A total of 10.0 g water was collected. The total weight loss was 11.4 g or 57% based on the weight of the nitric acid charge. The final yield was 58.6 g of dark brown fluid which FTIR at 1551-1554 $cm^{-1}$ indicated contained the nitro group ($C—NO_2$). The total nitric acid charge amounted to 40% by the weight of the starting organic.

Example #4

Nitrated Esters of Trimethylol Propane and Oleic Acid

To a three-necked round bottom flask, equipped with a thermometer, stirring bar, Dean-Stark trap, gas sparger, and a condenser, 53.0 g (0.059 mole) of FL-216 (Dover Chemical's synthetic esters of trimethylolpropane and oleic acid) was added. The batch was heated to 110° C. and 5.3 g (0.059 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 2.6 g water was collected. The total weight loss was 2.8 g or 53% based on the weight of the nitric acid charge. The final yield was 55.5 g of light brown fluid which FTIR at 1551-1554 $cm^{-1}$ indicated contained the nitro group ($C—NO_2$). The total nitric acid charge amounted to 10% by the weight of the starting organic.

Example #5

Nitrated Esters of Trimethylol Propane and Oleic Acid

To a three-necked round bottom flask, equipped with a thermometer, stirring bar, Dean-Stark trap, gas sparger, and a condenser, 61.6 g (0.069 mole) of FL-216 (Dover Chemical's synthetic esters of trimethylolpropane and oleic acid) was added. The batch was heated to 110° C. and 9.2 g (0.102 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 4.6 g water was collected. The total weight loss was 4.8 g or 52% based on the weight of the nitric acid charge. The final yield was 65.8 g of light brown fluid which FTIR at 1551-1554 $cm^{-1}$ indicated contained the nitro group ($C—NO_2$). The total nitric acid charge amounted to 15% by the weight of the starting organic.

Example #6

Nitrated Esters of Trimethylol Propane and Oleic Acid

To a three-necked round bottom flask, equipped with a thermometer, stirring bar, Dean-Stark trap, gas sparger, and a condenser, 50.9 g (0.057 mole) of FL-216 (Dover Chemical's synthetic esters of trimethylolpropane and oleic acid) was added. The batch was heated to 110° C. and 13.2 g (0.147 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 6.6 g water was collected. The total weight loss was 7.1 g or 54% based on the weight of the nitric acid charge. The final yield was 56.9 g of light brown fluid which FTIR at 1551-1554 $cm^{-1}$ indicated contained the nitro group ($C—NO_2$). The total nitric acid charge amounted to 26% by the weight of the starting organic.

Example #7

Nitrated Polyisobutylene

To a three-necked round bottom flask, equipped with a thermometer, stirring bar, Dean-Stark trap, gas sparger, and a condenser, 86.1 g (0.287 mole) of polyisobutylene (MW avg.=300) and 25.8 g (0.287 mole) of 70% nitric acid were charged. The batch was heated to and maintained at 70° C. for eight hours. The temperature of the reaction was slowly increased to 100° C. and maintained at that temperature for two hours before cooling to 80° C. The batch was air-blown or vacuum applied to remove essentially all entrapped water. A total of 12.9 g water was collected. The total weight loss was 17.3 g or 67% based on the weight of the nitric acid charge. The final yield was 94.5 g of dark yellow fluid which FTIR at 1551-1554 $cm^{-1}$ indicated contained the nitro group ($C—NO_2$). The total nitric acid charge amounted to 30% by the weight of the starting organic.

Example #8

Nitrated Polyisobutylene

To a three-necked round bottom flask, equipped with a thermometer, stirring bar, Dean-Stark trap, gas sparger, and a condenser, 136.3 g (0.136 mole) of polyisobutylene (MW avg.=1000) and 13.8 g (0.153 mole) of 70% nitric acid were charged. The batch was heated to and maintained at 70° C. for eight hours. The temperature of the reaction was slowly increased to 100° C. and maintained at that temperature for two hours before cooling to 80° C. The batch was air-blown or vacuum applied to remove essentially all entrapped water. A total of 6.9 g water was collected. The total weight loss was 8.1 g or 59% based on the weight of the nitric acid charge. The final yield was 142.0 g of light yellow fluid which FTIR at 1551-1554 $cm^{-1}$ indicated contained the nitro group ($C—NO_2$). The total nitric acid charge amounted to 10% by the weight of the starting organic.

Example #9

Nitrated $C_{18}$ Alpha-Olefins

To a three-necked round bottom flask, equipped with a thermometer, stirring bar, Dean-Stark trap, gas sparger, and a condenser, 63.8 g (0.253 mole) of $C_{18}$ alpha-olefin was charged. The batch was heated to 110° C. and 22.7 g (0.252 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 11.3 g water was collected. The total weight loss was 13.1 g or 58% based on the weight of the nitric acid charge. The final yield was 73.2 g of light brown fluid which FTIR at 1551-1554 $cm^{-1}$ indicated contained the nitro group ($C—NO_2$). The total nitric acid charge amounted to 35% by the weight of the starting organic.

Example #10

Nitrated Oleic Acid

To a three-necked round bottom flask, equipped with a thermometer, stirring bar, Dean-Stark trap, gas sparger, and a condenser, 77.2 g (0.271 mole) of oleic acid was charged. The batch was heated to 110° C. and 17.7 g (0.197 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 8.8 g water was collected. The total weight loss was 9.9 g or 56% based on the weight of the nitric acid charge. The final yield was 84.9 g of dark brown fluid which FTIR at 1551-1554 $cm^{-1}$ indicated contained the nitro group ($C—NO_2$). The total nitric acid charge amounted to 23% by the weight of the starting organic.

Example #11

Nitrated Nonyl Phenol

To a three-necked round bottom flask, equipped with a thermometer, stirring bar, Dean-Stark trap, gas sparger, and a condenser, 100.0 g (0.457 mole) of nonyl phenol was charged. At room temperature, 35.0 g (0.167 mole) of 30% nitric acid was charged slowly to keep the temperature below 100° C. After all nitric acid was added, the batch was maintained at 90° C. for two hours before cooling to 80° C. The batch was air-blown or vacuum applied to remove essentially all entrapped water. A total of 26.1 g water was collected. The final yield was 106.3 g of dark brown fluid which FTIR at 1551-1554 $cm^{-1}$ indicated contained the nitro group ($C—NO_2$). The total nitric acid charge amounted to 15% by the weight of the starting organic.

Except the nitration of nonyl phenol cited in the last example, all the results obtained from the above-illustrated laboratory batches were tabulated in Table I:

TABLE I

Nitration of organic compounds

| Raw materials ("RM") | RM (g) | RM (moles) | Nitric acid 70% (g) | Nitric Acid (moles) | Wt Loss (%) | Water collected (g) | Yield (g) |
|---|---|---|---|---|---|---|---|
| Soybean oil | 89.0 | 0.100 | 16.1 | 0.179 | 54 | 8.0 | 96.5 |
| Soybean oil | 50.0 | 0.056 | 20.0 | 0.222 | 57 | 10.0 | 58.6 |
| Soybean oil | 50.0 | 0.056 | 13.2 | 0.147 | 57 | 6.6 | 55.6 |
| FL216 | 53.0 | 0.059 | 5.3 | 0.059 | 53 | 2.6 | 55.5 |
| FL216 | 61.6 | 0.069 | 9.2 | 0.102 | 52 | 4.6 | 65.8 |
| FL216 | 50.9 | 0.057 | 13.2 | 0.147 | 54 | 6.6 | 56.9 |
| PIB ($MW_{300}$) | 86.1 | 0.287 | 25.8 | 0.287 | 67 | 12.9 | 94.5 |
| PIB ($MW_{1000}$) | 136.3 | 0.136 | 13.8 | 0.153 | 59 | 6.9 | 142.0 |
| $C_{18}$ olefin | 63.8 | 0.253 | 22.7 | 0.252 | 58 | 11.3 | 73.2 |
| Oleic acid | 77.2 | 0.271 | 17.7 | 0.197 | 56 | 8.8 | 84.9 |

The nitro compounds of Table II were evaluated as extreme-pressure additives, and the results summarized in Table III.

TABLE II

Nitro Compounds And Others Evaluated As EP Additives

| Source | Description | Abbreviation |
|---|---|---|
| Example #1 | Nitro soybean oil | Nitro Soy |
| Example #5 | Nitro synthetic ester | Nitro FL216 |
| Example #7 | Nitro polyisobutylene | Nitro PIB |
| Example #9 | Nitro olefin | Nitro $C_{18}$ |
| Example #10 | Nitro oleic acid | Nitro OA |
| Example #11 | Nitro nonyl phenol | Nitro NP |
| Commercial | 1-Nitropropane | Nitropropane |
| Commercial | 2-Ethylhexyl nitrate | EH Nitrate |

TABLE II-continued

| Nitro Compounds And Others Evaluated As EP Additives | | |
|---|---|---|
| Source | Description | Abbreviation |
| Dover Chemical | Chlorinated olefin (57% Cl) | X1057 |
| Dover Chemical | Sulfurized Fat (18% S) | Sulfurized Fat |
| Dover Chemical | Sulfurized Olefin (40% S) | Sulfurized $C_{14}$ |

The above-tabulated additives were evaluated in our laboratory using the lab-scaled tapping tester called Microtap II G8, distributed by Microtap USA, Inc. The extreme-pressure additives were evaluated at 10 wt. % in 100 ml sec-naphthenic oil. Holes were pre-drilled on the steel or stainless steel workpieces. A series of tapping were done through these predrilled holes at 300 RPM for stainless steel parts and at 450 RPM for regular steel parts. While the tap bit penetrated a 15 mm depth, all data points for torques which were generated due to friction were automatically recorded by the Microtap computer software, an average value was calculated.

In case of steel, this average torque for a nitro extreme-pressure additive or the "tested" torque was compared to the "standard" torque value obtained from a series of tapping done with the base oil alone without any extreme-pressure additive added. This average torque value associated with the pure base oil was served as a standard reference. From the ratio of the tested torque and standard torque, a tapping efficiency was calculated by taking standard torque divided by the tested torque times 100%. If an experimental extreme-pressure additive generated less torque, it would receive a tapping efficiency of greater than 100% which indicated that it performed well as a lubricating additive. The higher the tapping efficiency, the better the extreme-pressure additive performed. The standard was assigned a 100% tapping efficiency. A better performance than the standard run would result in greater than 100% and vice versa. Due to the repeatability of this tapping test, a difference greater than 3% in tapping efficiency was considered as statistically significant.

The tabulated data obtained with Microtap Tester on steel is summarized in Table III.

TABLE III

| Microtap Tapping Efficiency on Nitro EP Additives 450 RPM, 15 mm depth, Steel, 10 wt. % in oil | |
|---|---|
| Extreme Pressure Additive Sample | Tapping Efficiency |
| No additive (Standard) | 100% |
| X1057 (57% Cl) | 122% |
| Sulfurized Fat (18% S) | 133% |
| Sulfurized Olefin (40% S) | 123% |
| 2-EH Nitrate | 124% |
| Nitropropane | 129% |
| Nitro Soy | 133% |
| Nitro FL216 | 130% |
| Nitro $C_{18}$ | 127% |
| Nitro PIB | 126% |
| Nitro NP | 123% |

Examining closely the tabulated data, it is seen that all tested extreme-pressure additives performed better than the standard which is 100% based oil without any additive. Comparing to the chlorinated olefin, namely Dover's X-1057, all performed equally well or better. The nitro compounds derived from soybean oil and synthetic ester appeared to be slightly better than the chlorinated olefin as the extreme-pressure additive on steel. The commercial low molecular weight 1-nitropropane performed well as expected because of its —C—$NO_2$ group. The commercial 2-ethylhexyl nitrate, the ester of nitric acid and 2-ethyl hexanol also performed well on tapping steel parts.

The same Microtap runs tabulated in Table III were repeated using stainless steel bars instead of steel. The runs were conducted at slower speed of 300 RPM instead of 450 RPM. All additives again were tested at 10 weight percent level in oil. This time, the chlorinated olefin blend was served as the standard. The results were summarized and tabulated in Table IV.

TABLE IV

| Microtap Tapping Efficiency on Nitro EP Additives 300 RPM, 15 mm depth, Stainless Steel, 10 wt. % in oil | |
|---|---|
| EP Additive Sample | Tapping Efficiency % |
| No additive | (tap bit seized) |
| X1057 (57% Cl) (Standard) | 100% |
| Sulfurized Fat (18% S) | (tap bit seized) |
| Sulfurized Olefin (40% S) | (tap bit seized) |
| 2-EH Nitrate | (tap bit seized) |
| Nitropropane | 98% |
| Nitro Soy | 105% |
| Nitro FL-216 | 103% |
| Nitro $C_{18}$ | 100% |
| Nitro PIB | 99% |
| Nitro NP | 100% |

The run with chlorinated olefin or X-1057 was served as the standard with a 100% efficiency for calculating the tapping efficiencies because no tapping torque could be recorded with the run of pure oil (no additive) as the tap bit was seized up inside the pre-drilled holes of stainless steel work pieces. It is evident from the table that all nitro compounds fared equally well or slightly better than the chlorinated paraffin. Again nitro esters such as nitro soybean or nitro synthetic esters performed the best. All nitro hydrocarbons demonstrated to be adequate replacements for chlorinated extreme-pressure in processing stainless steel. Contrarily, both sulfurized additives, fat or non-fate, did not do as well with stainless steel as they did with regular steel. This is believed to be the reason why metal processing involving stainless steel or non-steel alloys such as nickel-based and titanium-based have traditionally always required the presence of chlorine. Comparing the N-containing additives, namely nitro extreme-pressure additives that include one embodiment of the invention and the commercial 1-nitropropane (hydrocarbons with C—N bonds) in comparison to 2-ethylhexyl nitrate (a hydrocarbon with C—O bonds,) it is seen that the nitro compounds as a class performed well as the extreme-pressure additive for both stainless and regular steel while the nitrated additive was not effective in processing stainless steel.

After testing with the lab-scaled Microtap tester, the nitro extreme-pressure additive derived from soybean oil was selected to undergo an industrial-scaled precision tapping with a Bridgeport CNC machine (CNC stands for Computer Numerical Control.) CNC equipment can be used to perform both precision drilling and tapping on a work piece. All operations were automated and programmed in advance. The work piece used was a steel or stainless steel panel 6" (15.25 cm)× 3" (7.62 cm) and ¾" (1.91 cm) thick, on which 400 holes were drilled, then the same holes were subsequently tapped. A good lubricant or fluid would drill and tap all 400 holes on the same panel. An inadequate lubricant or cutting fluid would fail immediately with the first tap or shortly thereafter.

The following results in Table V demonstrate the nitro extreme-pressure additives are effective in replacing both chlorinated and sulfurized extreme-pressure additives in processing metals.

TABLE V

Formulas of Cutting Fluids used in CNC Drilling & Tapping
Condition: 300 RPM, 400 Holes Maximum, Stainless Steel

| Components | Formula I | Formula II | Formula III | Formula IV |
|---|---|---|---|---|
| Sulfurized Fat (26.5% S) | 12.7% | 12.7% | 17.7% | — |
| Chlorinated paraffin (53% Cl) | 5.0% | — | — | — |
| Nitro soybean (Example #1) | — | 5.0% | — | 17.7% |
| Lard oil | 3.5% | 3.5% | 3.5% | 3.5% |
| sec-naphthenic oil | 78.8% | 78.8% | 78.8% | 78.8% |
| RESULTS: | | | | |
| Total holes tapped | 400 | 400 | 5 (tap bit broken) | 400 |

The results of Table V confirm the role of chlorinated extreme-pressure additives in the processing of tough metals such as stainless steel. Again, the sulfurized extreme-pressure additive was not effective, probably due to the non-reactivity of the sulfurized additive toward metallic surfaces which are low in iron such as stainless steel as illustrated by the compositional analysis provided in Table VI for typical compositions of industrial special low-iron or non-iron alloys. Conversely, nitro extreme-pressure additives such as nitro soybean oil not only could replace chlorinated compounds in processing stainless steel as shown, but also could replace sulfurized additives in cutting fluids.

Finally, the nitro soybean oil was chosen to represent this novel class of extreme-pressure additives in a cutting fluid in a industrial field application. A commercial cutting fluid which was successful in processing stainless and all special alloys tabulated in Table VI was chosen to be the standard fluid to make metal parts using a full-industry scaled Acme-Gridley Screw Machine. This fluid was then modified with all chlorinated extreme-pressure additives taken out and replaced with nitro soybean oil of Example #1. Both fluids performed equally well in this application with all three metal composites: stainless steel, titanium-based, and nickel-based alloys.

TABLE VI

Typical composition of Low-Steel or non-Steel Special Alloys

| Stainless Steel (A286) | Titanium-Based Alloy | Nickel-Based Waspalloy | Nickel-Based Inconel |
|---|---|---|---|
| C = 0.08% | C = 0.08% | C = 1.0% | C = 0.1% |
| Mn = 2.0% | N = 0.05% | Mn = 0.5% | Mn = 1.0% |
| Si = 1.0% | O = 0.4% | S = 0.02% | S = 0.01% |
| Cr = 13-16% | H = 0.01% | Si = 0.75% | Si = 0.5% |
| Ni = 24-27% | Ti = Bal | Cr = 18% | Cr = 21-25% |
| Mo = 1-2% | Fe = 0.5% | Ni = Bal | Ni = 58-63% |
| V = 0.1-0.5% | | Mo = 3.5% | Co = 1.0% |
| Ti = 1.9-2.3% | | Cu = 0.1% | Al = 1% |
| Al = 0.35% | | Co = 12% | |
| Fe = Bal | | Ti = 2.6% | |
| | | Al = 1% | |
| | | Fe = 2% | |
| | | Zr = 0.1% | |

In addition to being an effective novel extreme-pressure additive, nitro compounds covered in this invention are proved to be a very good antiwear additives as well. Good extreme-pressure and wear-protection properties are both necessary for formulating any lubricant in particular hydraulic fluids, engine oils, and gear oils. Nitrated soybean oil of Example #1 and nitrated $C_{18}$-alpha olefins of Example #9 were used to illustrate this end-use application in a Four-Wear Test based on ASTM D4172. The results of this study are tabulated in Table VII. The decreasing average wear scar diameter indicates an improvement in antiwear properties of an additive.

TABLE VII

Four-Ball Wear Test
(Conditions: 1500 rpm, ambient temperature, 40 kg load)

| Tested Samples | Wear Scar Diameter (mm) |
|---|---|
| No additive, straight oil | 1.62 |
| 1 wt % ZDDP[(1)] | 0.47 |
| 2 wt % ZDDP | 0.41 |
| 1 wt % Nitro soybean (Example #1) | 0.65 |
| 1 wt % Nitro $C_{18}$ olefin (Example #9) | 0.57 |
| 0.5 wt % Nitro soybean + 0.5 wt % Doverphos ® 274[(2)] | 0.52 |

[(1)]is commercially available zinc dithiophosphate
[(2)]is Dover Chemical's dilauryl hydrogen phosphite.

Both ZDDP and Doverphos® 274 are very good and well-proven commercial antiwear additives.

This aspect of the invention describes a method to synthesize a novel class of nitrated extreme-pressure additives used in lubricating oils. This embodiment also describes a method to synthesize this class of additives by reacting nitric acid with fatty or synthetic raw materials such as triglycerides, methyl or synthetic esters including water-dispersible esters, fatty or synthetic alcohols including polyglycols, fatty acids such as oleic acid, tall oil fatty acid or unsaturated carboxylic acids, and with olefins.

What has been shown is that nitric acid can react with: (a) animal fat or glycerides from animal fat such as lard, pigskin grease, chicken fat, cod or fish oil, sheep fat, blubber, etc.; (b) vegetable oils including oils from oilseeds, such as cashew, castor bean, castor oil, flax seed—linseed oil, grape seed—grape seed oil, hemp (cannabis), mustard olives and olive pits—olive oil, poppy seeds—poppyseed oil, rapeseed, canola (cultivar of rapeseed), safflower, sesame seed, sunflower, as well as other vegetable oils such as almond, apricot, argan, avocado, corn (maize)—corn oil, cotton plant seed—cottonseed oil, coconut—coconut oil, fusarium—actually a fungus, hazelnut, neem oil, palm—palm oil—from the fruit of the African palm tree, palm kernel oil—from the seed of the African palm tree, peanut—peanut oil, pumpkin seed, rice bran, soybean—soybean oil is commonly marketed as "Vegetable Oil", walnut, canola, soybean oil, corn oil, etc.; (c) olefins, internal or alpha, short chain or polymers including polyalkylene oxides, polyalkylenes, polyalkylated aromatics, etc.; and (d) unsaturated hydrocarbons, including alkenes, arylalkyls, alkylaryls, etc.

High rosin fatty acids may be substituted in whole or in part for non-high rosin fatty acids used in embodiments described elsewhere herein. It is recognized that sources of $C_6$-$C_{24}$ fatty acids include, but are not limited to, those obtained from natural sources such as animal tallows and greases, vegetable, coconut, palm, marine oils, etc. Such acids may also be produced synthetically from petroleum sources. For example, fatty acids may be produced by oxidation of hydrocarbons.

This embodiment of the invention describes the reactions and reactant yields between nitric acid and fatty compounds in which nitric acid charge can range from 0.1 mole to 3.0 mole for each mole of triglycerides or 0.1 to 1.0 mole of nitric acid for each mole of fatty acids/esters, alcohols, or olefins.

What is also known is that nitric acid can oxidize essentially all organic matter, particularly hydrocarbons, and therefore, this chemical reaction extends to any chemical that contains a hydroxyl group, hydroalkyl chain, or alkyl group that can be reacted with nitric acid to provide a nitrated additive of this invention. These nitrated hydrocarbons are useful as the extreme-pressure additives of the instant invention.

The hereinabove described portion of the invention describes the use of the above-mentioned oil-based nitro extreme-pressure additives in a lubricant formulation for metal processing applications, for an industrial lubricating formula or other applications requiring the use of a lubricant and which are an effective partial or total replacement for the currently available chlorinated, sulfurized, and phosphated compounds, usable in steel, stainless steel, special non- or low-ferrous alloy processing applications. This interchangeability of the novel nitro EP towards the conventional EP additives is due to the synergism between the novel additive and other traditional ones.

TABLE VIII

Oil-Based EP Synergy Study-Microtap, Tapping Results
(Conditions: 100 SUS Naphthenic oil, 300 rpm, 15 mm depth, Stainless Steel)

| Run | Tested Samples | Avg. Tapping Torque (N-cm) |
|---|---|---|
| 1 | 10 wt % Drawfree 7[(1)] | tap bit seized |
| 2 | 9 wt % Drawfree 7 + 1 wt % Nitro-soybean oil (Ex. #1) | 256 |
| 3 | 10 wt % Mayco Base 1351[(2)] | tap bit seized |
| 4 | 9 wt % Mayco Base 1351 + 1 wt % Nitro-soybean oil (Ex. #1) | 252 |
| 5 | 10 wt % TPS-32[(3)] | tap bit seized |
| 6 | 9 wt % TPS-32 + 1 wt % Nitro-Oleic Acid (Ex. #10) | 266 |
| 7 | 5 wt % Drawfree 7 | tap bit seized |
| 8 | 4 wt % Drawfree 7 + 1 wt % Nitro-FL-216[(4)] (Ex. #5) | 260 |
| 9 | 5 wt % Mayco Base 1351 | tap bit seized |
| 10 | 4 wt % Mayco Base 1351 + 1 wt % Nitro-PIB (Ex. #7) | 258 |

[(1)]Dover Chemical's commercial phosphate acid ester containing 7% P;
[(2)]Dover Chemical's commercial sulfurized fat and olefins;
[(3)]commercial 32% S polysulfides;
[(4)]Dover Chemical's pentaerythritol synthetic ester.

Thus, looking at Table VIII, it is seen that 10 wt % of the conventional EP additives such as Drawfree 7, or Mayco 1351, or TPS-32 presented very little EP performance on stainless steel. And 1 wt % Nitro EP could not prevent tap bit from being seized (the results of 1 wt % nitro-EP's alone were not tabulated), but the combination of 1 wt % nitro-EP and 9% other EP's enabled stainless steel tapping.

Further, the novel nitro EP of this invention were tested with various commercial applications using the laboratory bench test, Falex Pin and V-Block according to ASTM D-3233. This test is used to measure both lubricity and EP properties of a tested fluid. The failure loads recorded in lbs indicate the EP properties while the torque in lb.-in. indicates the friction or lubricity of a tested fluid.

TABLE IX

Some Industrial Applications Using Falex Pin-V-Block Tester

| Run | Tested Samples | Failure Load (lbs)/ Max Torque (lb-in) |
|---|---|---|
| 1 | Straight 100 SUS petroleum oil | 1,250/75 |
| 2 | Commercial Bar & Chain Oil | 1,250/65 |
| 3 | Commercial Bar & Chain Oil + 2 wt % Nitro-soybean (Ex. #1) | 4,500/63 |
| 4 | Commercial generic drilling mud without any EP/lubricity additives | 1,250/93 |
| 5 | Commercial generic drilling mud + 3 wt % sulfurized EP/ lubricity additives | 2,250/75 |
| 6 | Commercial generic drilling mud + 3 wt % Nitro - soybean oil (Ex. #1) | 2,500/52 |

Thus, it is seen that the class of novel nitro EP additives as exemplified with nitrated soybean oil cited in Example #1 shows an improvement in both extreme-pressure and lubricity properties compared to the above-studied industrial lubricants.

These nitro or nitrated additives can be combined with other extreme-pressure or lubricity additives and be used in straight oil formulations or even in water-based, soluble oil formulations. Other extreme-pressure additives can be combined with the nitrated additives, and can include blends with chlorine-, sulfur- and phosphorus-containing compounds in which case the nitrated additive acts as a partial replacement for traditional lubricant additives.

Soluble Oil Formulas Containing Nitrated EP Additives and Synergistic Extreme-Pressure Water-Dispersible Blends While the initial class of nitrated extreme pressure additives hereinabove described are designed for oil-based lubricants, they can be blended in oil and water with commercial emulsifiers or surfactants to provide extreme pressure and lubricity properties to water-dispersible lubricants or metal working fluids. These water-dispersible blends are conventionally called soluble oils, semi-synthetics or synthetic coolants. In fact, these novel water-dispersible lubricating extreme pressure packages or blends of nitrated compounds, often work synergistically with traditional extreme pressure lubricants.

For metals such as copper, aluminum, iron, or steel, under low to medium loading and speed, or in light-duty metal processes, the water-soluble or water-dispersible lubricating additives can be soaps or salts made out of the reactions between a caustic base or alkanolamines such monoethanolamine or triethanolamine and a fatty acid or phosphate acid esters. For heavy-duty applications involving high loads, high speeds, or hardened steel, or stainless steel, a water-soluble or water-dispersible chlorinated or chlorine-containing extreme pressure additive is necessary. Such an additive can be a soap or a salt derived from a strong base and a chlorinated fatty acid, or from an ester of a polyglycol and a chlorinated fatty acid. These water-soluble or water-dispersible soaps, salts, or ethoxylated esters work effectively in processing stainless steel parts, but they tend to cause corrosion or rusting of the finished parts due to presence of their by-product which take the form of water-soluble chlorides or hydrochloric acid.

However, the amount of corrosion can be minimized, and/or eliminated by using a combination of a non-chlorinated extreme pressure additive in conjunction with a nitrated additive. This synergistic relationship is unexpected as illustrated in the following Table IX illustrating the compositions while Table X illustrates the results obtained from testing the compositions.

TABLE X

Formulations of Soluble Oils and Microtap Testing Results

| Compositions(%) | A | B | C | D | E | F | G | H | I |
|---|---|---|---|---|---|---|---|---|---|
| 100 SUS petroleum oil | 75.0 | 60.0 | 60.0 | 60.0 | 60.0 | 60.0 | 60.0 | 60.0 | 60.0 |
| Tap water | 5.0 | 5.0 | 5.0 | 5.0 | 5.0 | 5.0 | 5.0 | 5.0 | 5.0 |
| Petroleum Sodium sulfonate(1) | 10.0 | 10.0 | 10.0 | 10.0 | 10.0 | 10.0 | 10.0 | 10.0 | 10.0 |
| Polyethylene glycol (PEG 600) mono-tallate(2) | 10.0 | 10.0 | 10.0 | 10.0 | 10.0 | 10.0 | 10.0 | 10.0 | 10.0 |
| Soybean oil | | 15.0 | | | | | | | |
| Nitrated soybean oil | | | 1.5 | 15.0 | | | | 1.5 | 1.5 |
| Sulfurized fat & olefin (25% S)(3) | | | | | 15.0 | | | 13.5 | |
| Alkyl Phosphate ester (7% P)(4) | | | | | | 15.0 | | | 13.5 |
| Chlorinated paraffins (52% CI)(5) | | | | | | | 15.0 | | |

(1)is medium MW-490 petroleum sodium sulfonate (commercially available from Lockhart Corporation as Locksol 1450)
(2)is polyethylene glycol mono-tallate (Dover Chemical's EM-600) a commercial emulsifier commonly used in formulating soluble oils, semi-synthetics, and synthetic coolants
(3)is the 60/40 blend of Dover Chemical's Mayco Base 4220 or 18% S fat and Mayco Base 1540 or 40% S olefins
(4)is Dover Chemical's Drawfree 7
(5)is Dover Chemical's Paroil 152

TABLE XI

AVERAGE TAPPING TORQUES, N-cm

| | Composition | | | | | | | | |
|---|---|---|---|---|---|---|---|---|---|
| | A | B | C | D | E | F | G | H | I |
| @300 rpm | seized | seized | seized | 293 | seized | seized | seized | seized | 285 |
| @350 rpm | seized | seized | seized | 285 | seized | seized | 275 | 267 | 260 |

Conditions:
300-350 rpm, Stainless Steel, 5% Dilution (in tap water)

The compositions and performance thereof of A, B, and G serve as standards against which to measure the performance of the other extreme pressure additives. In comparing the performance of the compositions of D, E, and F the effectiveness of nitrated soybean as the extreme-pressure lubricating additive on stainless steel is clearly illustrated while the use of sulfurized and phosphate esters are not effective. In comparing the performance of compositions D and G, it is illustrated that nitrated compounds can be used as suitable replacement for chlorinated extreme pressure additives in water-based formulations, however, the chlorinated composition not being desirable for reasons articulated previously. Comparing the performance of the compositions of C, H, and I, it is seen that there is synergy between the nitrated extreme pressure compositions when used with conventional extreme pressure additives such as sulfurized and phosphates compositions, which were ineffective when used singly (see performance data of the compositions of E and F). This is verified by the lack of performance of composition C when used alone. It is only by combining the nitrated additive with a non-chlorinated extreme pressure additive composition that the combination was effective when either component used alone was ineffective for the targeted application.

Therefore, what has been described are water-dispersible lubricant formulas or soluble oils containing the novel nitro-EP additive, either alone or synergistically blended with traditional EP additives such as sulfurized and phosphate, to effectively replace chlorinated EP in processing of all metals, especially steel and stainless steel.

In addition to the soluble oil formulas in which the oil-based novel nitrated EP additive is made water-emulsifiable with an aid of emulsifying system, the aqueous lubricating blends can be made by using the novel class of water-dispersible nitro-EP additives of which synthetic processes and applications are now being described in comparison to the conventional water-dispersible chlorinated alkanolamine salt.

Water-Soluble Extreme Pressure Additives

Example 12

Nitrated Polyethylene Glycyl Tallate

To a three-necked round bottom flask, equipped with a thermometer, stirring bar, Dean-Stark trap, gas sparger, and a condenser, 89 g (0.100 mole) of Dover Chemical's EM-600 or polyethylene glycol tallate esters and 8.9 g (0.10 mole) of 70% nitric acid were charged. The batch was heated to and maintained at 25-140° C., preferably at 60-120° C., more preferably at 100° C. for eight hours. The batch was nitrogen-blown to remove essentially all entrapped water. A total of 4.5 g water was collected. The total weight loss was 4.5 g or 50% based on the weight of the nitric acid charge. The final yield was 93.4 g of dark brown fluid which FTIR at 1551-1554 $cm^{-1}$ indicated contained the nitro group ($C—NO_2$).

Example #13

Triethanolamine (TEA) Salt of Nitrated Oleic Acid

To a three-necked round bottom flask, equipped with a thermometer, stirring bar, Dean-Stark trap, gas sparger, and a condenser, 77.2 g (0.271 mole) of oleic acid was charged. The batch was heated to 110° C. and 12.2 g (0.136 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 6.1 g water was collected. The total weight loss was 6.1 g or 50% based on the weight of the nitric acid charge. The final yield was 83.3 g of dark brown fluid which FTIR at 1551-1554 $cm^{-1}$ indicated contained the nitro group ($C—NO_2$). After cooling to 50° C., 41.7 g (0.278 mole) of triethanolamine was added to neutralize all nitrated oleic acid to yield a water-dispersible extreme-pressure additive.

Example #14

Triethanolamine (TEA) Salt of Nitrated Tall-Oil Fatty Acid (TOFA)

To a three-necked round bottom flask, equipped with a thermometer, stirring bar, Dean-Stark trap, gas sparer, and a condenser, 77.2 g (0.271 mole) of TOFA was charged. The batch was heated to 110° C. and 17.7 g (0.197 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 8.8 g water was collected. The total weight loss was 9.9 g or 56% based on the weight of the nitric acid charge. The final yield was 84.9 g of dark brown fluid which FTIR at 1551-1554 $cm^{-1}$ indicated contained the nitro group ($C—NO_2$). After cooling to 50° C., 42.2 g (0.283 mole) of triethanolamine was added to neutralize all nitrated TOFA to yield a water-dispersible extreme-pressure additive.

Example #15

Polyethylene Glycyl Esters of Nitrated Oleic Acid

To a three-necked round bottom flask, equipped with a thermometer, stirring bar, Dean-Stark trap, gas sparer, and a condenser, 77.2 g (0.271 mole) of oleic acid was charged. The batch was heated to 110° C. and 12.2 g (0.136 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 6.1 g water was collected. The total weight loss was 6.1 g or 50% based on the weight of the nitric acid charge. The final yield was 83.3 g of dark brown fluid which FTIR at 1551-1554 $cm^{-1}$ indicated contained the nitro group ($C—NO_2$). To make the desired esters, 183.4 g (0.306 mole) of polyethylene glycol was added into the reactor flask, cooked for 5 hours at 120-150° C. with nitrogen purging. The final yield was 261.1 g of water-dispersible product.

Example #16

Triethanolamine (TEA) Salt of Chlorinated Stearic Acid 100 g (0.244 mole) of Dover Chemical's DA-8527 (chlorinated stearic acid containing 28% chlorine by weight) was blended with 50.0 g (0.333 mole) of triethanolamine, and the whole mixture was heated to 80° C.

The synthesized additives of Example #12 through Example #16, along with several others served as standards, evaluated as extreme-pressure additives. The results are summarized in Table XII, and the experimental testing results were tabulated in Table XIII.

TABLE XII

| Nitro Compounds And Others Evaluated As Water-Dispersible EP Additives | | |
|---|---|---|
| Source | Description | Abbreviation |
| Ex. #12 | Nitrated Polyethylene Glycyl Tallate | Nitro-EM600 |
| Ex. #13 | Triethanolamine (TEA) salt of Nitrated Oleic acid | TEA(Nitro-OA) |
| Ex. #14 | Triethanolamine (TEA) salt of Nitrated Tall-Oil Fatty Acid | TEA(Nitro-TOFA) |
| Ex. #15 | Polyethylene Glycyl Esters of Nitrated Oleic acid | PEG(Nitro-OA) |
| Ex. #16 | Triethanolamine (TEA) salt of Chlorinated Stearic Acid | TEA(DA-8527) |
| Dover | Polyethylene Glycyl Esters of TOFA | EM-600 |
| Comm. | Triethanolamine (TEA) salt of Oleic acid | TEA (OA) |
| Comm. | Triethanolamine (TEA) salt of Tall-Oil Fatty Acid (TOFA) | TEA (TOFA) |
| Comm. | Chlorinated Soluble Oil (11% Chlorine) | Cl-SolOil |

The above-tabulated additives in Table XII were evaluated using the lab-scaled tapping tester called Microtap II G8, distributed by Microtap USA, Inc. The extreme-pressure additives were evaluated at 5-10 wt. % in tap water. Holes were pre-drilled on stainless steel work-pieces. A series of tapping were done through these predrilled holes at 300 RPM for stainless steel parts. While the tap bit penetrated a 15 mm depth, all data points for torque which were generated due to friction were automatically recorded by the Microtap computer software, and an average value was calculated.

If an experimental extreme-pressure additive generated less torque, it is considered to perform better as a lubricating or extreme-pressure additive. If tap bit seized during tapping operation, the lubricating or extreme-pressure additive was considered inadequate for processing of stainless steel.

The tabulated data obtained with Microtap Tester on steel is shown in Table XIII.

TABLE XIII

| Microtap Average Tapping Torques on Nitro EP Additives | | | | |
|---|---|---|---|---|
| Run | (EP) Additives | Water Mixture Clarity | Tap Torque at 5% (N-cm) | Tap Torque at 10% (N-cm) |
| 1 | EM-600 | clear | Tap bit seized | Tap bit seized |
| 2 | TEA (OA) | clear | Tap bit seized | Tap bit seized |
| 3 | TEA (TOFA) | clear | Tap bit seized | Tap bit seized |
| 4 | Cl-SolOil | milky | 280 | 250 |
| 5 | TEA(DA-8527) | hazy | Tap bit seized | 271 |
| 6 | Nitro-EM600 | clear | 262 | 225 |
| 7 | TEA(Nitro-OA) | hazy | 250 | 215 |
| 8 | TEA(Nitro-TOFA) | hazy | Tap bit seized | 270 |
| 9 | PEG(Nitro-OA) | hazy | Tap bit seized | 290 |

Test Conditions: 300 RPM, 15 mm depth, Stainless Steel, 5-10 wt. % in tap water

Run #1 through Run #5 serve as standards in evaluating the performance of the others. Aqueous extreme-pressure additives which contain the nitro functional group are illustrated in Run #6 through Run #7. In analyzing the results, and focusing on Run #1, it is seen that water-dispersible ethoxylated fatty esters which have no chlorine or nitrate are not useful in tapping stainless steel parts. The same outcome is obtained with the plain TEA salt of regular oleic acid or of TOFA. On the other hand, the water-dispersible soluble oil which contains about 11% chlorine in its formula (Run #4) and the TEA salt of chlorinated stearic acid (Run #5) demonstrate the effectiveness of chlorine-containing extreme-pressure additives in the processing of stainless steel. All nitro extreme-pressure additives (Runs #6-#8) performed equally well to their chlorinated counterpart, namely the TEA salt of chlorinated stearic acid illustrated in Run #5. Only Run #9 with the PEG esters of nitrated oleic acid appeared to be less effective than the chlorinated extreme-pressure standard, perhaps due to the partial loss of nitro ($NO_2$) groups during the esterification process. The nitrated ethoxylated tallate esters of Run #6 appeared to have the best extreme-pressure performance as well as the best water dispersibility as well.

The tabulated data obtained with Microtap Tester on aluminum is summarized in Table XIV.

TABLE XIV

| Microtap Average Tapping Torques on Aluminum with Nitro EP Additives | | | | |
|---|---|---|---|---|
| Run# | % (EP) Additives | Tap Water Mixture Clarity | Tap Torque (N-cm) | Tapping Efficiency (%) |
| 1 | Tap water | clear | 157 | 100 |
| 2 | 2 wt % Commercial | milky | 133 | 118 |

TABLE XIV-continued

| Microtap Average Tapping Torques on Aluminum with Nitro EP Additives | | | | |
|---|---|---|---|---|
| Run# | % (EP) Additives | Tap Water Mixture Clarity | Tap Torque (N-cm) | Tapping Efficiency (%) |
| | Soluble Oil | | | |
| 3 | 1 wt % EM-600 | clear | 153 | 102 |
| 4 | 1 wt % Nitro-EM600 | translucent | 143 | 110 |
| 5 | 1 wt % TEA(Nitro-OA) | translucent | 128 | 123 |
| 6 | 2 wt % Soluble Oil with Nitro-Soybean (Comp. D of Table X) | milky | 131 | 120 |

Test Conditions: 450 RPM, 15 mm depth, Aluminum, 1-2 wt. % in tap water

Run #1 with plain tap water was served as the standard. Its tapping efficiency was assigned to be 100%. To calculate the tapping efficiency of a tested sample, the average tapping torque in N-cm is divided by with 157 N-cm (tapping torque of the standard, Run #1) and the reciprocal of the resultant ratio is multiplied by 100% to get the new tapping efficiency. Run #2, which serves as the bench-mark, involves a non-chlorine currently available commercial soluble oil which has been used in the market for processing aluminum alloys. This lubricant is only 50% active therefore a 2 wt % level was used. The novel nitro-EP additives are compared to this commercial soluble oil. A 1 wt % composition using Dover Chemical's EM-600 or Polyethylene Glycyl Esters of TOFA in Run #3 was proven to be ineffective in lubricating aluminum surfaces in an aqueous environment. The 1 wt % composition of Nitro-EM600 or Nitrated Polyethylene Glycyl Tallate (Example #12) in Run #4 showed a significant improvement in EP performance but still fell short of the commercial soluble oil. Run #5 with a 1 wt % TEA (Nitro-Oleic acid) or Triethanolamine (TEA) salt of Nitrated Oleic acid cited in Example #13 was considered the best, surpassing even the currently available commercial product. Finally, Run #6 is the soluble oil containing 15% nitro soybean which performed as well as the currently available commercial product.

This aspect of the invention describes a method to synthesize a novel class of nitrated extreme-pressure additives used in lubricating oils. This embodiment also describes a method to synthesize this class of additives by reacting nitric acid with fatty or synthetic raw materials such as triglycerides, methyl or synthetic esters including water-dispersible esters, fatty acids such as oleic acid, tall oil fatty acid or unsaturated carboxylic acids, and with olefins. Subsequent to the synthesis of the nitrated additive, a post-synthesis reaction is effected in which the oil-based lubricant is chemically modified to become water-dispersible, and used in water-based metal working fluids or other industrial lubricants. This post-synthesis reaction typically involved the formation of an alkanolamine salt or alkanolamide by reaction with alkanolamines. Non-limiting illustrative examples of akanolamines include, but are not limited to monoethanolamine, diethanolamine, triethanolamine, mono-isopropanolamine, di-isopropanolamine, tri-isopropanolamine, and mixtures thereof. Alternatively, the additive can be esterified to form a water-dispersible ethoxylated fatty ester by reacting the nitrated fatty acids with water-soluble polyglycols such as polyethylene glycols. Water-dispersible nitrated EP additives can also be obtained by nitrating fatty esters of polyethylene glycols using nitric acid or nitrogen dioxides.

As described in this section, the aqueous solubilizing agent is selected from the group consisting of an amine and a polyglycol. More preferably, the amine is selected from the group consisting of an alkanolamine having from 1 to 10 carbon atoms and the polyglycol is selected from the group consisting of alkylene glycols having a molecular weight ranging from about 200 to 6,000. Most preferably, the alkanolamine is selected from the group consisting of monoethanolamine, diethanolamine and triethanolamine and the alkylene glycol is a polyethylene glycol.

This aspect of the invention describes the use of the above-mentioned nitrated or nitro extreme-pressure additives in an aqueous lubricant formulation after chemical modification for metal processing applications, for an industrial lubricating formula or other applications requiring the use of a lubricant and which are an effective replacement for the currently available chlorinated compounds and usable with stainless steel processing applications.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

This invention has been described in detail with reference to specific embodiments thereof, including the respective best modes for carrying out each embodiment. It shall be understood that these illustrations are by way of example and not by way of limitation.

What is claimed is:

1. A process of using a water-dispersible extreme-pressure additive which comprises the steps of:

nitrating at least one moiety selected from the group consisting of $C_2$-$C_{30}$ unsaturated fatty acids, $C_2$-$C_{30}$ unsaturated fatty oils, esters derived from the reaction of $C_1$-$C_{20}$ alcohols with unsaturated $C_2$-$C_{30}$ fatty acids, polyglycol esters of $C_2$-$C_{30}$ unsaturated fatty acids, polymers derived from $C_2$-$C_{20}$ olefins, polymers derived from $C_4$-$C_{20}$ diolefins, $C_8$-$C_{20}$ copolymers derived from polyolefins and vinyl aromatics, $C_4$-$C_{30}$ alkylated phenols, $C_4$-$C_{28}$ internal or terminal olefins, said nitrated moiety further having a terminal carboxylic acid group;

adding at least one emulsifier or surfactant selected from the group consisting of an alcohol amine or an alkylene ether glycol to said carboxylic acid group of said nitrated moiety to make said nitrated moiety water-dispersible;

adding said nitrated moiety to an oil-based lubricant; and adding at least one non-chlorine containing moiety to said oil-based lubricant, a combination of said non-chlorine containing moiety and said nitrated moiety improving a performance of said extreme-pressure, water-dispersible additive in at least one physical characteristic when compared to using said additive without said combination and further wherein said non-chlorine containing moiety is selected from the group consisting of a sulfur-containing moiety and a phosphorus-containing moiety.

2. The process of claim 1 wherein said at least one moiety to be nitrated is selected from the group consisting of $C_8$-$C_{30}$ unsaturated fatty acids, $C_8$-$C_{30}$ unsaturated fatty oils, esters derived from the reaction of $C_4$-$C_{20}$ alcohols with unsaturated $C_8$-$C_{30}$ fatty acids, $C_4$-$C_{18}$ polyolefins, $C_4$-$C_{18}$ polydiolefins, $C_8$-$C_{20}$ copolymers derived from polyolefins and vinyl aromatics and $C_8$-$C_{20}$ alkylated phenols.

3. The process of claim 1 wherein said unsaturated fatty oil is selected from the group consisting of animal fats, vegetable oils and mixtures thereof.

4. The process of claim 3 wherein said vegetable oil is selected from the group consisting of cashew, castor bean, castor, linseed, grape seed, hemp, mustard, olive, poppyseed, rapeseed, canola, safflower, sesame, sunflower, almond, apricot, argan, avocado, corn, cottonseed, coconut, fusarium, hazelnut, neem, palm, palm kernel, peanut, pumpkin, rice bran, soybean, walnut, corn, canola, caster and tall oils.

5. The process of claim 1 wherein said $C_4$-$C_{30}$ alkylated phenol is selected from the group consisting of $C_{3-30}$ alkyl alcohols, $C_{5-30}$ aryl alcohols, $C_{4-30}$ arylalkyl alcohols $C_{6-30}$ alkylaryl alcohols or esters thereof.

6. The process of claim 1 wherein said $C_2$-$C_{20}$ polyolefin has a molecular weight of approximately between 300 and 4500.

7. The process of claim 6 wherein said $C_2$-$C_{20}$ polyolefin has a molecular weight of approximately between 300 and 1000.

8. The process of claim 1 wherein said $C_2$-$C_{20}$ polyolefin is a polyalkene selected from the group consisting of polybutenes, polyisobutylenes and mixtures thereof.

9. A water-dispersible, extreme-pressure additive which comprises:

at least one nitrated moiety selected from the nitrated reaction product of the group consisting of C2-C30 unsaturated fatty acids, C2-C30 unsaturated fatty oils, esters derived from the reaction of C1-C20 alcohols with unsaturated C2-C30 fatty acids, polyglycol esters of C2-C30 unsaturated fatty acids, polymers derived from C2-C20 olefins, polymers derived from C4-C20 diolefins, C8-C20 copolymers derived from polyolefins and vinyl aromatics, C4-C30 alkylated phenols, C4-C28 internal or terminal olefins, said nitrated moiety further having a terminal carboxylic acid group;

at least one emulsifier or surfactant selected from the group consisting of an alcohol amine or an alkylene ether glycol added to said carboxylic acid group of said nitrated moiety to make said nitrated moiety water-dispersible; and at least one non-chlorine containing moiety to said additive, a combination of said non-chlorine containing moiety and said nitrated moiety improving a performance of said extreme-pressure, water-dispersible additive in at least one physical characteristic when compared to using said additive without said combination, and further wherein said non-chlorine containing moiety is selected from the group consisting of a sulfur-containing moiety and a phosphorus-containing moiety.

10. The additive of claim 9 wherein said at least one nitrated product is selected from the nitrated reaction product of the group consisting of $C_8$-$C_{30}$ unsaturated fatty acids, $C_8$-$C_{30}$ unsaturated fatty oils, esters derived from the reaction of $C_4$-$C_{20}$ alcohols with unsaturated $C_8$-$C_{30}$ fatty acids, $C_4$-$C_{18}$ polyolefins, $C_4$-$C_{18}$ polydiolefins, $C_8$-$C_{20}$ copolymers derived from polyolefins and vinyl aromatics and $C_8$-$C_{20}$ alkylated phenols.

11. The additive of claim 9 wherein said unsaturated fatty oil is selected from the group consisting of animal fats, vegetable oils and mixtures thereof.

12. The additive of claim 11 wherein said vegetable oil is selected from the group consisting of cashew, castor bean, castor, linseed, grape seed, hemp, mustard, olive, poppyseed, rapeseed, canola, safflower, sesame, sunflower, almond, apricot, argan, avocado, corn, cottonseed, coconut, fusarium, hazelnut, neem, palm, palm kernel, peanut, pumpkin, rice bran, soybean, walnut, corn, canola, caster and tall oils.

13. The additive of claim 9 wherein said $C_4$-$C_{30}$ alkylated phenol is selected from the group consisting of $C_{4-30}$ alkyl alcohols, $C_{5-30}$ aryl alcohols, $C_{4-30}$ arylalkyl alcohols $C_{6-30}$ alkylaryl alcohols or esters thereof.

14. The additive of claim 9 wherein said $C_2$-$C_{20}$ polyolefin has a molecular weight of approximately between 300 and 4500.

15. The additive of claim 14 wherein said $C_2$-$C_{20}$ polyolefin has a molecular weight of approximately between 300 and 1000.

16. The additive of claim 9 wherein said $C_2$-$C_{20}$ polyolefin is a polyalkene selected from the group consisting of polybutenes, polyisobutylenes and mixtures thereof.

17. The additive of claim 9 wherein said non-chlorine containing moiety is said phosphorus-containing moiety.

18. A process of using a water-dispersible extreme-pressure additive which comprises the steps of:

nitrating at least one unsaturated moiety selected from the group consisting of $C_2$-$C_{30}$ unsaturated fatty acids, $C_2$-$C_{30}$ unsaturated fatty oils, esters derived from the reaction of $C_1$-$C_{20}$ alcohols with unsaturated $C_2$-$C_{30}$ fatty acids, polyglycol esters of $C_2$-$C_{30}$ unsaturated fatty acids, polymers derived from $C_2$-$C_{20}$ olefins, polymers derived from $C_4$-$C_{20}$ diolefins, $C_8$-$C_{20}$ copolymers derived from polyolefins and vinyl aromatics, $C_4$-$C_{30}$ alkylated phenols, $C_4$-$C_{28}$ internal or terminal olefins, said nitrated moiety further having a terminal carboxylic acid group;

adding at least one emulsifier or surfactant selected from the group consisting of an alcohol amine or an alkylene ether glycol to said carboxylic acid group of said nitrated moiety to make said nitrated moiety water-dispersible;

adding said nitrated moiety to an oil-based lubricant; and said nitrated moiety reducing a tapping torque when compared to using said additive without said combination.

19. The process of claim 18 wherein said at least one unsaturated moiety is selected from the group consisting of $C_8$-$C_{30}$ unsaturated fatty acids, $C_8$-$C_{30}$ unsaturated fatty oils, esters derived from the reaction of $C_4$-$C_{20}$ alcohols with unsaturated $C_8$-$C_{30}$ fatty acids, $C_4$-$C_{18}$ polyolefins, $C_4$-$C_{18}$ polydiolefins, $C_8$-$C_{20}$ copolymers derived from polyolefins and vinyl aromatics and $C_8$-$C_{20}$ alkylated phenols.

20. The process of claim 18 wherein said unsaturated fatty oil is selected from the group consisting of animal fats, vegetable oils and mixtures thereof.

21. The process of claim 20 wherein said vegetable oil is selected from the group consisting of cashew, castor bean, castor, linseed, grape seed, hemp, mustard, olive, poppyseed, rapeseed, canola, safflower, sesame, sunflower, almond, apricot, argan, avocado, corn, cottonseed, coconut, fusarium, hazelnut, neem, palm, palm kernel, peanut, pumpkin, rice bran, soybean, walnut, corn, canola, caster and tall oils.

22. The process of claim 18 wherein said $C_4$-$C_{30}$ alkylated phenol is selected from the group consisting of $C_{3-30}$ alkyl alcohols, $C_{5-30}$ aryl alcohols, $C_{4-30}$ arylalkyl alcohols $C_{6-30}$ alkylaryl alcohols or esters thereof.

23. The process of claim 18 wherein said $C_2$-$C_{20}$ polyolefin has a molecular weight of approximately between 300 and 4500.

24. The process of claim 23 wherein said $C_2$-$C_{20}$ polyolefin has a molecular weight of approximately between 300 and 1000.

25. The process of claim 18 wherein said $C_2$-$C_{20}$ polyolefin is a polyalkene selected from the group consisting of polybutenes, polyisobutylenes and mixtures thereof.

* * * * *